US010005591B2

(12) United States Patent
Al-Housseiny et al.

(10) Patent No.: US 10,005,591 B2
(45) Date of Patent: Jun. 26, 2018

(54) EXTENDABLE POURING DEVICE AND METHOD OF USING SAME

(71) Applicant: Talal T. Al-Housseiny, Princeton, NJ (US)

(72) Inventors: Talal T. Al-Housseiny, Princeton, NJ (US); Talal A. Al-Housseiny, Beirut (LB)

(73) Assignee: Talal T. Al-Housseiny, Princeton, NJ (US)

( * ) Notice: Subject to any disclaimer, the term of this patent is extended or adjusted under 35 U.S.C. 154(b) by 85 days.

(21) Appl. No.: 15/196,783

(22) Filed: Jun. 29, 2016

(65) Prior Publication Data

US 2018/0002069 A1 Jan. 4, 2018

(51) Int. Cl.

| | |
|---|---|
| ***B67B 7/00*** | (2006.01) |
| ***B65D 25/48*** | (2006.01) |
| ***B44D 3/12*** | (2006.01) |
| ***B65D 47/06*** | (2006.01) |
| *B65D 25/28* | (2006.01) |

(52) U.S. Cl.

CPC ..... *B65D 25/48* (2013.01); *B44D 3/12* (2013.01); *B65D 47/066* (2013.01); *B65D 25/2867* (2013.01); *B65D 2547/066* (2013.01)

(58) Field of Classification Search

CPC ..... B65D 25/40–25/48; B65D 47/06–47/0828

USPC ..... 220/700, 701, 702, 733; 229/125.04, 229/125.08; 222/527–529, 570, 569, 566, 222/574

See application file for complete search history.

(56) References Cited

U.S. PATENT DOCUMENTS 2,077,341 A * 4/1937 Martin ..... B65D 5/743 210/514

2,129,819 A * 9/1938 Chamberlain ..... B65D 47/061 220/DIG. 19

(Continued)

FOREIGN PATENT DOCUMENTS

| | | |
|---|---|---|
| GB | 2454930 | 5/2009 |
| NL | 1019827 | 7/2003 |

OTHER PUBLICATIONS

English Abstract; Netherland Application No. NL1019827; Publication Date: Jul. 25, 2003; 1 page.

*Primary Examiner* — Frederick C Nicolas
*Assistant Examiner* — Randall Gruby
(74) *Attorney, Agent, or Firm* — Blank Rome LLP; Matthew J. Esserman

(57) ABSTRACT

A pouring device for pouring material from a container and method of using same are disclosed. The pouring device is movable between open and closed configurations. An embodiment provides a pouring device that includes a main body which comprises a main body portion, an attachment portion, and at least two hinges which connect to at least two movable walls extending angularly from the main body to form a conduit when the pouring device is in the open configuration. Another embodiment provides a pouring device that has a central portion rigidly connecting two walls. The attachment portion is placed within the container below an upper plane of a rim of the container. Embodiments foster a pouring solution that can be easily and quickly mounted within a container and that allows a user to close the container while the pouring device is mounted entirely within the container.

53 Claims, 13 Drawing Sheets

(56) References Cited

U.S. PATENT DOCUMENTS 2,180,045 A 11/1939 Gardner
2,546,052 A * 3/1951 Wilkins ..... B65D 5/744 222/528
2,750,085 A * 6/1956 Bode ..... B65D 25/42 222/528
2,772,823 A * 12/1956 Plamann ..... B65D 75/5805 222/527
3,093,273 A * 6/1963 Borah ..... B65D 47/063 222/498
3,102,667 A * 9/1963 Ullevig ..... B65D 25/48 222/569
3,154,226 A * 10/1964 Petitto ..... B65D 47/046 222/528
3,463,366 A * 8/1969 Spencer ..... B65D 25/48 222/570
4,000,838 A * 1/1977 Bogert ..... B65D 17/4012 222/529
4,192,440 A * 3/1980 Smith ..... B65D 25/525 222/528
4,216,880 A 8/1980 Drelichowski
4,555,048 A * 11/1985 Hamman ..... B65D 47/063 222/478
4,560,081 A * 12/1985 Adams ..... B65D 47/063 220/260
4,886,206 A * 12/1989 Martinez ..... B65D 1/265 229/123.1
4,907,714 A * 3/1990 Gatz ..... B44D 3/12 220/698
5,234,133 A * 8/1993 Kensey ..... B65D 47/06 220/700
5,669,526 A * 9/1997 Keyfauver ..... B44D 3/12 206/508
5,676,306 A * 10/1997 Lankin ..... B65D 3/20 229/138
6,250,518 B1 6/2001 Thirkettle
6,983,869 B1 * 1/2006 Stevens ..... B44D 3/128 220/701
9,533,796 B2 * 1/2017 Selina ..... B65D 25/44
2004/0074933 A1 4/2004 Tilbrook
2007/0278257 A1 12/2007 Antal, Sr. et al.
2015/0232233 A1 8/2015 Kent
2016/0318671 A1 * 11/2016 Sessions ..... B65D 47/063

* cited by examiner

EXTENDABLE POURING DEVICE AND METHOD OF USING SAME

FIELD OF THE INVENTION

Embodiments are in the field of pouring devices. More particularly, embodiments disclosed herein relate to pouring devices for pouring material from a container and methods of using same which, inter alia, foster a pouring solution that can be easily and quickly mounted within a container and that allows a user to close the container while the pouring device is mounted entirely within the container.

BACKGROUND OF THE INVENTION

Pouring a material stored within a container and controlling the flow of the material often presents challenges. In particular, it is often difficult to prevent residual material from: (a) entering and contaminating the lid cavity and/or the rim area of the container; and (b) dripping onto the sides of the container. This residual material and associated spills may eventually lead to loss of material, and user inconvenience owing to cleanliness and owing to difficulties in re-applying the lid to close the container, e.g., with residual material in the lid cavity and/or rim area. As an example, pouring a material (e.g., paint) from a container (e.g., paint bucket/container/can) often leads to the contamination of the rim area and usually creates spills and drips, which require frequent clean-up of the container and/or the surrounding work area.

To address these challenges, to control the flow, to reduce material waste, and to improve user experience, a number of pouring systems (e.g., pourers, pouring solutions, spouts, lips, funnels, conduits, nozzles, etc.) have been proposed. These known pouring systems typically protrude out of the container to achieve their intended use. A problem with these known pouring systems has been that they also protrude out of the container when not in use, thereby preventing the closure of the container. In addition, the protruding pouring system cannot be stowed inside a closed container, thereby making it unready for future use. The protruding pouring system also hinders the transportation of the container (e.g., in stackable configuration), and can present a hazard by contaminating items or clothing of people in the vicinity of the container.

Thus, it is desirable to provide a pouring device for pouring material from a container and method of using same that are able to overcome the above disadvantages.

Advantages of the present invention will become more fully apparent from the detailed description of the invention hereinbelow.

SUMMARY OF THE INVENTION

Embodiments are directed to a pouring device for pouring material from a container, the pouring device being movable between a closed configuration and an open configuration different from the closed configuration. The pouring device comprises: a main body comprising a main body portion, an attachment portion, and at least two hinges which connect to at least two walls extending angularly from the main body portion to form a conduit when the pouring device is in the open configuration. The attachment portion is placed within the container below an upper plane of a rim of the container when the pouring device is in the open and closed configurations. At least a portion of the at least two walls extends exteriorly from the container above the upper plane of the rim of the container such that the material from the container is allowed to flow through the conduit, when the pouring device is in the open configuration. The at least two walls retract to within the container below the upper plane of the rim of the container, when the pouring device is in the closed configuration, thereby allowing the container to be closed by a closure mechanism with the pouring device within the container. The attachment portion may be configured to be attached to an interior portion of the container.

In an embodiment, the interior portion of the container comprises a surface of the rim below the upper plane. The interior portion of the container may comprise a bottom surface of the rim, an anterior portion of the rim facing a central space within the container, and/or a posterior portion of the rim facing an inner sidewall of the container.

In an embodiment, the interior portion of the container comprises an inner sidewall of the container.

In an embodiment, the attachment portion is configured to not be attached to a lid of the container.

In an embodiment, the attachment portion comprises an attachment mechanism, wherein the attachment portion is configured to be attached to the interior portion of the container via the attachment mechanism.

In an embodiment, the combination of the main body portion and the at least two walls are substantially planar, when the pouring device is in the closed configuration, and the combination of the main body portion and the at least two walls are not substantially planar, when the pouring device is in the open configuration.

In an embodiment, the pouring device is biased toward only the closed configuration, only the open configuration, or both the closed and open configurations.

In an embodiment, each of the hinges comprises an item selected from the group consisting of a perforation, crease, score, a section with less thickness than surrounding material, a section with less density than surrounding material, and a combination thereof.

In an embodiment, the conduit is closed preventing the material from the container from flowing through the conduit, when the pouring device is in the closed configuration.

In an embodiment, the pouring device further comprises a central portion positioned between the at least two hinges. The central portion may extend angularly from the main body portion, when the pouring device is in the open configuration.

In an embodiment, the central portion comprises a fastening mechanism which allows for maintaining closure of the conduit when the pouring device is in the closed configuration. The fastening mechanism may releasably fasten the central portion to at least one of the at least two walls when the pouring device is in the closed configuration.

In an embodiment, the central portion comprises a fastening mechanism which allows for maintaining opening of the conduit when the pouring device is in the open configuration. The fastening mechanism may releasably fasten the central portion to an exterior portion of the container when the pouring device is in the open configuration.

Embodiments are also directed to a method of using a pouring device for pouring material from a container, the pouring device being movable between a closed configuration and an open configuration different from the closed configuration. The method comprises: providing a pouring device comprising a main body which comprises a main body portion, an attachment portion, and at least two hinges which connect to at least two walls extending angularly from the main body portion to form a conduit when the pouring device is in the open configuration; placing the attachment portion within the container below an upper plane of a rim of the container; moving the pouring device from the closed configuration to the open configuration, while the attachment portion is positioned within the container below the upper plane of the rim of the container, by extending at least a portion of the two walls exteriorly from the container above the upper plane of the rim of the container such that the material from the container is allowed to flow through the conduit, when the pouring device is in the open configuration; and moving the pouring device from the open configuration to the closed configuration, while the attachment portion is positioned within the container below the upper plane of the rim of the container, by retracting the at least two walls to within the container below the upper plane of the rim of the container, when the pouring device is in the closed configuration, thereby allowing the container to be closed by a closure mechanism with the pouring device within the container. The step of placing may comprise attaching the attachment portion to an interior portion of the container.

In an embodiment, the interior portion of the container comprises a surface of the rim below the upper plane. The interior portion of the container may comprise a bottom surface of the rim, an anterior portion of the rim facing a central space within the container, and/or a posterior portion of the rim facing an inner sidewall of the container.

In an embodiment, the interior portion of the container comprises an inner sidewall of the container.

In an embodiment, the step of placing does not comprise attaching the attachment portion to a lid of the container.

In an embodiment, the attachment portion comprises an attachment mechanism, wherein the step of placing comprises attaching the attachment portion to the interior portion of the container via the attachment mechanism.

In an embodiment, the combination of the main body portion and the at least two walls are substantially planar, when the pouring device is in the closed configuration, and the combination of the main body portion and the at least two walls are not substantially planar, when the pouring device is in the open configuration.

In an embodiment, the pouring device is biased toward only the closed configuration, only the open configuration, or both the closed and open configurations.

In an embodiment, each of the hinges comprises an item selected from the group consisting of a perforation, crease, score, a section with less thickness than surrounding material, a section with less density than surrounding material, and a combination thereof.

In an embodiment, the conduit is closed preventing the material from the container from flowing through the conduit, when the pouring device is in the closed configuration.

In an embodiment, the method further comprises positioning a central portion between the at least two hinges. The central portion may extend angularly from the main body portion, when the pouring device is in the open configuration.

In an embodiment, the central portion comprises a fastening mechanism, wherein the method further comprises maintaining closure of the conduit via the fastening mechanism when the pouring device is in the closed configuration. The method may yet further comprise releasably fastening the central portion to at least one of the at least two walls via the fastening mechanism when the pouring device is in the closed configuration.

In an embodiment, the central portion comprises a fastening mechanism, wherein the method further comprises maintaining opening of the conduit via the fastening mechanism when the pouring device is in the open configuration. The method may yet further comprise releasably fastening the central portion to an exterior portion of the container via the fastening mechanism when the pouring device is in the open configuration.

Embodiments are also directed to a pouring device for pouring material from a container, the pouring device being movable between a closed configuration and an open configuration different from the closed configuration. The pouring device comprises: a main body comprising a main body portion, an attachment portion, and at least one hinge which connects to a central portion rigidly connecting two walls when the pouring device is in the open and closed configurations. The central portion and two walls extend angularly from the main body portion to form a conduit when the pouring device is in the open configuration. The attachment portion is placed within the container below an upper plane of a rim of the container when the pouring device is in the open and closed configurations. At least a portion of the at least two walls extends exteriorly from the container above the upper plane of the rim of the container such that the material from the container is allowed to flow through the conduit, when the pouring device is in the open configuration. The at least two walls retract to within the container below the upper plane of the rim of the container, when the pouring device is in the closed configuration, thereby allowing the container to be closed by a closure mechanism with the pouring device within the container. The attachment portion may be configured to be attached to an interior portion of the container.

In an embodiment, the interior portion of the container comprises a surface of the rim below the upper plane. The interior portion of the container may comprise a bottom surface of the rim, an anterior portion of the rim facing a central space within the container, and/or a posterior portion of the rim facing an inner sidewall of the container.

In an embodiment, the interior portion of the container comprises an inner sidewall of the container.

In an embodiment, the attachment portion comprises an attachment mechanism, wherein the attachment portion is configured to be attached to the interior portion of the container via the attachment mechanism.

In an embodiment, the conduit is closed preventing the material from the container from flowing through the conduit, when the pouring device is in the closed configuration.

In an embodiment, the central portion comprises a fastening mechanism which allows for maintaining closure of the conduit when the pouring device is in the closed configuration. The fastening mechanism may releasably fasten the central portion to the main body portion when the pouring device is in the closed configuration.

In an embodiment, the central portion comprises a fastening mechanism which allows for maintaining opening of the conduit when the pouring device is in the open configuration. The fastening mechanism may releasably fasten the central portion to an exterior portion of the container when the pouring device is in the open configuration.

BRIEF DESCRIPTION OF THE DRAWINGS

The detailed description will refer to the following drawings, wherein like reference numerals refer to like elements, and wherein:

FIG. 7C is provided at an angle greater than that of a conduit of the pouring device shown in FIG. 7B;

DETAILED DESCRIPTION OF THE INVENTION

Figure 1A:
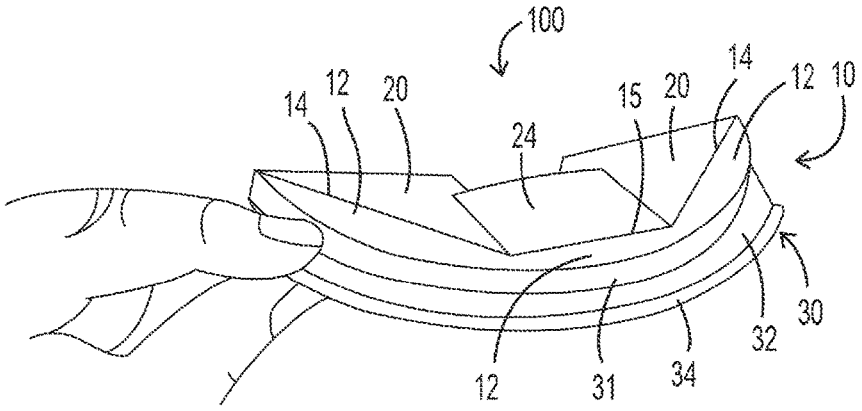
FIG. 1A is a diagram illustrating a perspective view of an embodiment of a pouring device with foldable walls for pouring material from a container, held by a user of the pouring device, wherein the pouring device is in a closed configuration.

It is to be understood that the figures and descriptions of the present invention may have been simplified to illustrate elements that are relevant for a clear understanding of the present invention, while eliminating, for purposes of clarity, other elements found in a typical pouring device for pouring material from a container or typical method of using a pouring device for pouring material from a container. Those of ordinary skill in the art will recognize that other elements may be desirable and/or required in order to implement the present invention. However, because such elements are well known in the art, and because they do not facilitate a better understanding of the present invention, a discussion of such elements is not provided herein. It is also to be understood that the drawings included herewith only provide diagrammatic representations of the presently preferred structures of the present invention and that structures falling within the scope of the present invention may include structures different than those shown in the drawings. Reference will now be made to the drawings wherein like structures are provided with like reference designations.

For purposes of this disclosure, the term "planar" refers to an element or combination of elements that may have any thickness, and having sides defining the thickness that are parallel with each other.

Embodiments are directed to a pouring device for pouring material from a container, the pouring device being movable between a closed configuration and an open configuration different from the closed configuration. The pouring device is a foldable, bendable, movable, and/or optionally removable device that may be mounted (e.g., by a user, distributor, retail associate, or added by a worker or machine at a manufacturing facility) within an interior of the container. The container may be any type that contains a pourable material such as solids (e.g., pellets, grains, powder, etc.), liquids (e.g., paint, chemicals, polymers, detergent, primers, etc.), or combinations thereof (e.g., slurry solution, cement, suspensions, etc.). The container may comprise any dimensions, size, composition, and shape. Examples of a suitable container may be, for example, a paint bucket/can, laundry detergent container, jug, rectangular can, carton, glass jar, food container, etc.

The pouring device may be mounted (e.g., in a removable manner) to the interior portion of the container via an attachment portion. The attachment portion is designed with dimensions, size, composition, and shape to correspond with or accommodate a container's particular dimensions, size, composition, and shape (or can be generally accommodating for many or most containers of particular type (e.g., paint bucket)) at the location of intended attachment within the interior portion of the container. In fact, the pouring device and portions thereof (including the attachment portion mentioned herein) may vary in dimensions, size, composition, and shape depending on the dimensions, size, composition, and shape of the container (which may be, for example, cylindrical, cubical, rectangular, triangular), and especially the dimensions, size, composition, and shape of the interior portion of the container, i.e., at the location of attachment of the pouring device. As an example, the attachment portion may have an arc, semi-circular shape, or linear shape to correspond with the shape of the rim or inner sidewall of a container (e.g., paint bucket).

Alternatively, the pouring device may be permanently mounted or permanently bonded to the container by manufacturing the pouring device as part of the container itself during the manufacturing process. For example, the pouring device may be manufactured as one integral piece with the container during initial formation/manufacture of the container or via permanent bond or via other permanent attachment mechanism/process during any phase of construction of the container, or even via permanent bonding after the container has been initially manufactured. A portion of the pouring device or the entire pouring device may be manufactured as part of the container via processes such as molding (e.g., if the container and pouring device both comprise plastic or other moldable material). When permanently mounting or permanently bonding, the pouring device may utilize the attachment portion itself to effect the permanent mounting or permanent bonding of the main body portion of the pouring device to the interior of the container, or the process may alternatively omit the attachment portion. When the attachment portion is omitted, the main body portion of the pouring device may be directly permanently mounted or permanently bonded to the container.

When mounted, a user unfolds/moves the pouring device from the closed configuration to the open configuration by extending the at least two walls from the main body portion via hinges, thereby creating a conduit which extends (at least partially) externally from the container above an upper plane of the rim of the container. This conduit creates a passageway for the contents/material of the container to flow through, without interfering with the integrity of the rim.

When pouring is complete, the user folds/moves the pouring device from the open configuration back to the closed configuration, by folding back the walls towards the main body portion via the hinges. In the closed configuration, the container may be closed via a closure mechanism with the pouring device still attached to the container, thereby closing the container with the pouring device contained entirely within the interior of the container. Thus, the pouring device can be stored/stowed and mounted inside the container and ready for future use.

Portions or all of the pouring device may comprise a suitable material that allows for folding/bending/collapsing/moving of the walls such as cardboard, paperboard, paper, wood, plastic, elastomers (e.g., rubber, silicone, etc.) metal, polymers (e.g., polyurethane, etc.), or combinations thereof. The material may be chosen for reusability of the pouring device, or, alternatively, the material may be chosen based on a disposable (i.e., one-time use only) variation.

Figure 1B:
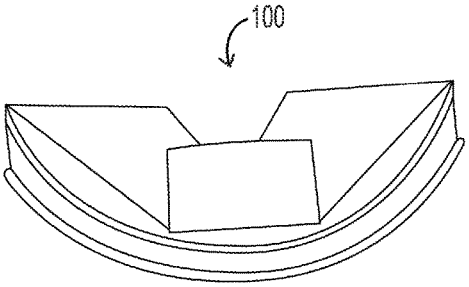
FIG. 1B is a diagram illustrating another perspective view of the pouring device shown in FIG. 1A.

With reference to FIGS. 1A and 1B, shown are diagrams illustrating perspective views of an embodiment of a pouring device 100 with foldable walls 20, 22 (see FIG. 1D which illustrates walls 22), and foldable central portion 24 for pouring material from a container, wherein the pouring device 100 is in a closed configuration.

Figure 1C:
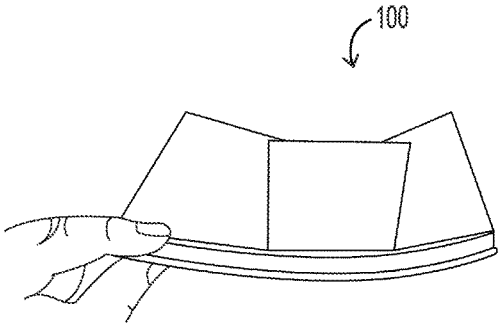
FIG. 1C is a diagram illustrating a side view of the pouring device shown in FIG. 1A, held by the user of the pouring device, wherein the pouring device is in an open configuration.
Figure 1D:
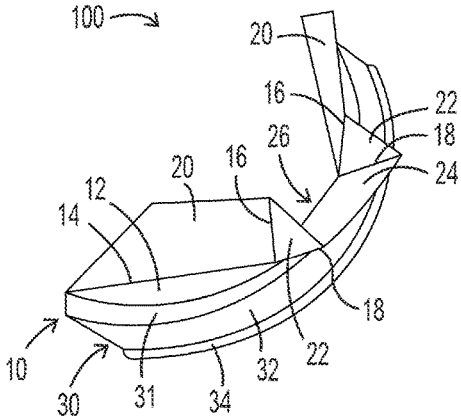
FIG. 1D is a diagram illustrating a perspective view of the pouring device shown in FIG. 1C.

With reference to FIGS. 1C and 1D, shown are diagrams illustrating side and perspective views, respectively, of the pouring device 100 shown in FIG. 1A, wherein the pouring device 100 is in an open configuration.

Figure 2A:
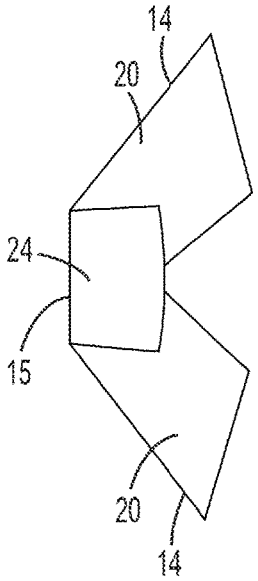
FIG. 2A is a diagram illustrating a plan view of the pouring device shown in FIG. 1A, with the attachment portion and the main body portion omitted for simplifying understanding for purposes of explanation only.

With reference to FIG. 2A, shown is a diagram illustrating a plan view of the pouring device 100 shown in FIG. 1A, with the attachment portion 30 and main body portion 12 omitted for simplifying understanding for purposes of explanation only.

Figure 2B:
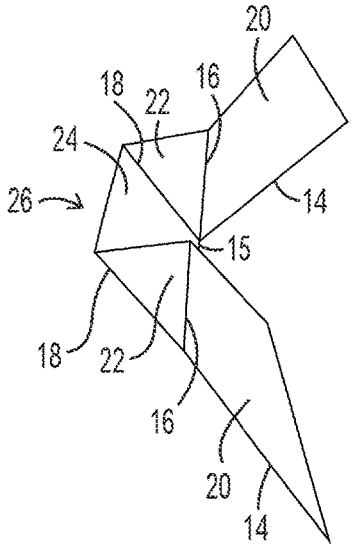
FIG. 2B is a diagram illustrating a perspective view of the pouring device shown in FIG. 1C, with the attachment portion and the main body portion omitted for simplifying understanding for purposes of explanation only.

With reference to FIG. 2B, shown is a diagram illustrating a perspective view of the pouring device 100 shown in FIG. 1C, with the attachment portion 30 and main body portion 12 omitted for simplifying understanding for purposes of explanation only.

Walls 20 are movably connected to the main body portion 12 via hinges 14. Each wall 22 is movably connected to a wall 20 via a hinge 16. A central portion 24 is movably connected to the main body portion 12 via hinge 15. The central portion 24 is also movably connected to each wall 22 via hinges 18. The movability of the walls 20, 22 (and central portion 24, when included in an embodiment) via the hinges 14, 16, 18 occurs when the pouring device 100 is moved from the closed configuration to the open configuration and when the pouring device 100 is moved from the closed configuration to the open configuration.

Hinges 16 are shown as moving towards an inward path (i.e., toward a longitudinal central axis of the conduit 26) when the pouring device 100 is moved from the open configuration to the closed configuration. However, the movement of hinges 16 may alternatively follow an outward path (i.e., away from the longitudinal central axis of the conduit 26). Alternatively, one hinge 16 may follow an inward path while the other hinge 16 may follow an outward path, when the pouring device is moved from the open configuration to the closed configuration.

The pouring device may vary in the number, positioning, dimensions, size, and/or shape, of the walls and/or hinges than that illustrated in the drawings. For example, a pouring device comprising only two walls may be contemplated. In this two-wall configuration, each wall (e.g., 20) would still be movably connected to the main body portion 12 via hinges 14. However, each wall 20 would also be connected to each other via a central hinge (not shown)—and without a central portion 24 therebetween. In this two-wall configuration, the two walls would provide a V-shaped conduit for the material 195 to flow from the interior of the container, when the pouring device is in an open configuration. Alternatively, in an embodiment when additional walls are contemplated (i.e., more walls than employed in, for example, the FIG. 1D embodiment), each wall may be movably connected to an adjacent wall via a hinge.

Figure 3A:
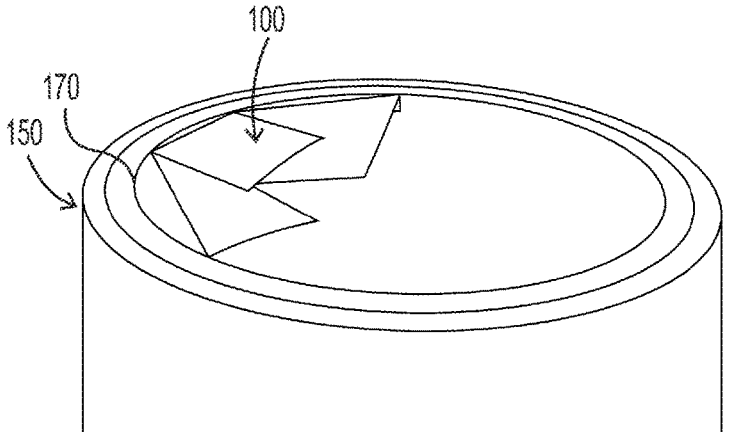
FIG. 3A is a diagram illustrating a perspective view of the pouring device shown in FIG. 1A, attached to an interior portion of the container.
Figure 3B:
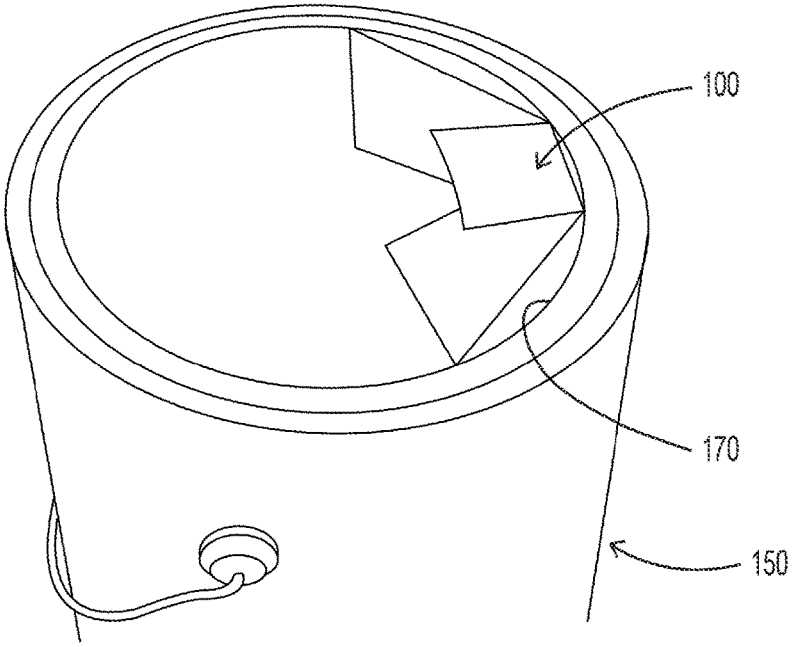
FIG. 3B is a diagram illustrating another perspective view of the container and attached pouring device shown in FIG. 3A.

With reference to FIG. 3A, shown is a diagram illustrating a perspective view of the pouring device 100 shown in FIG. 1A, attached to an interior portion of the container 150. FIG. 3B is a diagram illustrating another perspective view of the container 150 and attached pouring device 100 shown in FIG. 3A.

Figure 4A:
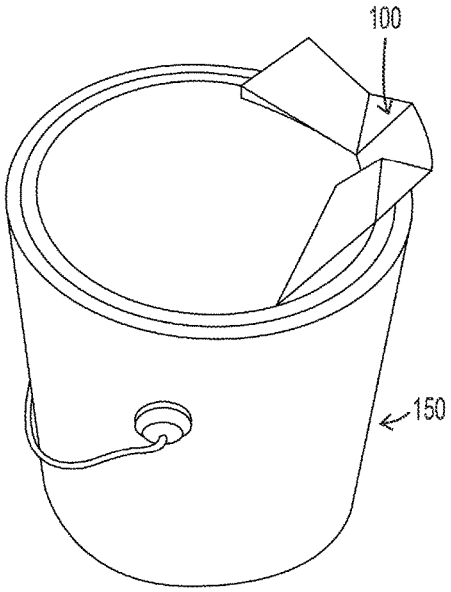
FIG. 4A is a diagram illustrating a perspective view of the pouring device shown in FIG. 1C, attached to an interior portion of the container.
Figure 4B:
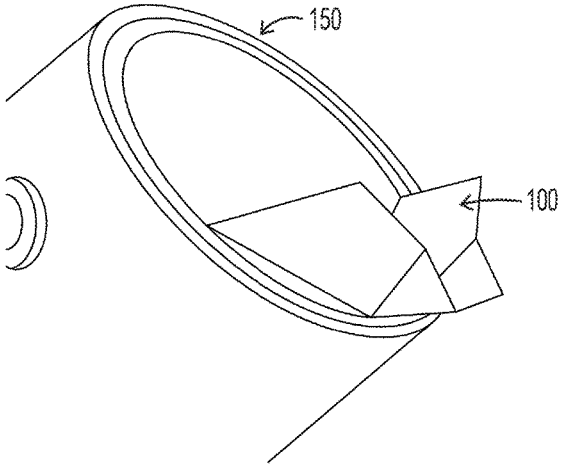
FIGS. 4B-4C and 4E are diagrams illustrating multiple perspective views of the container and attached pouring device shown in FIG. 4A.
Figure 4C:
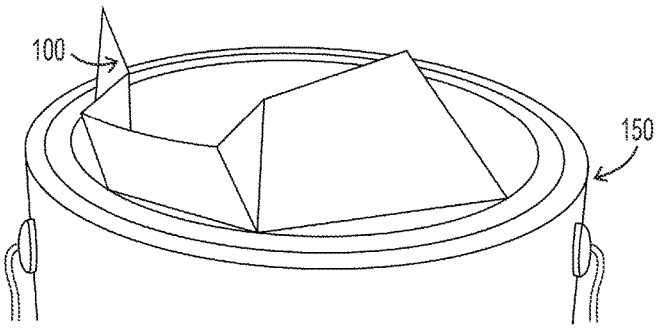
Figure 4D:
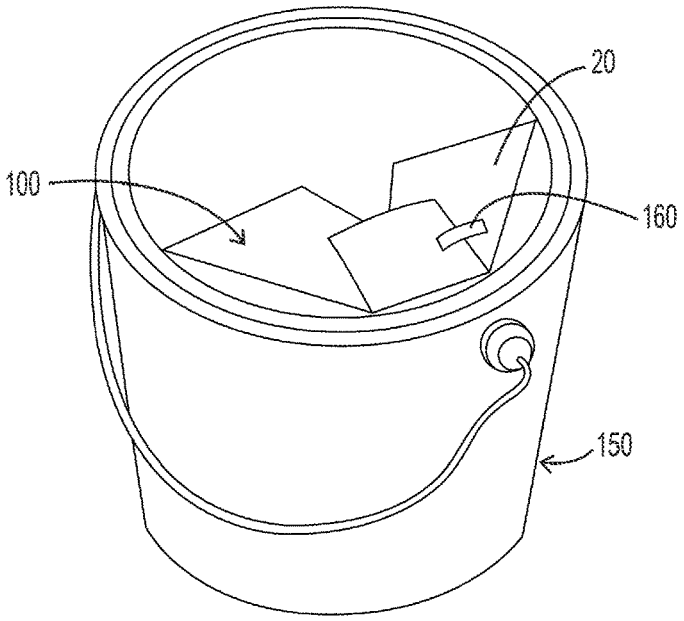
FIG. 4D is a diagram illustrating another perspective view of the container and attached pouring device shown in FIG. 3A, with FIG. 4D including a fastening mechanism when the pouring device is in a closed configuration, and with FIG. 4E including a fastening mechanism when the pouring device is in an open configuration.
Figure 4E:
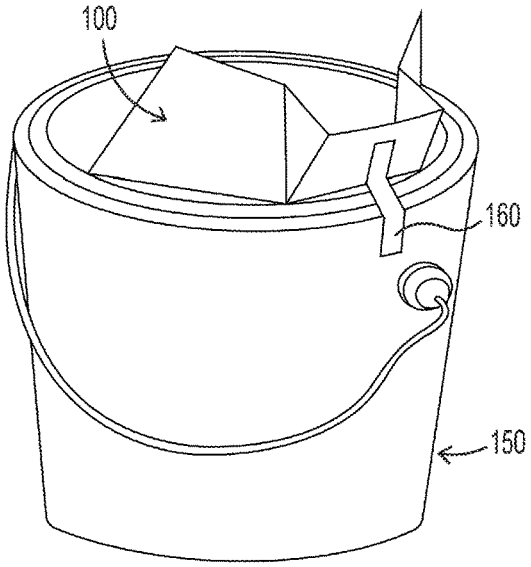

With reference to FIG. 4A, shown is a diagram illustrating a perspective view of the pouring device 100 shown in FIG. 1C, attached to an interior portion of the container 150. FIGS. 4B-4C and 4E are diagrams illustrating multiple perspective views of the container 150 and attached pouring device 100 shown in FIG. 4A, and FIG. 4D is a diagram illustrating another perspective view of the container 150 and attached pouring device 100 shown in FIG. 3A, with FIG. 4D including a fastening mechanism 160 for fastening the central portion 24 to wall(s) 20 (or alternatively wall(s) 22), when the pouring device 100 is in a closed configuration, and with FIG. 4E including a fastening mechanism 160 for fastening the central portion 24 to an exterior portion of the container 150, when the pouring device 100 is in an open configuration. The fastening mechanism 160 in FIG. 4D and the fastening mechanism 160 in FIG. 4E may be the same fastening mechanism, or different fastening mechanisms from each other.

The fastening mechanism 160 may be permanent or releasable and may be initially integrally formed along with the manufacturing of the remaining portions of the pouring device. The fastening mechanism 160 may comprise any mechanism for fastening such as a chemical adhesive, a magnetic mechanism, mechanical interlock, hook and loop fastener, tape, glue, friction-fit, strap, etc. Alternatively, the fastening mechanism may be added to the central portion 24 (and/or the walls 20, 22) at the time of or before attaching the pouring device 100 to the container 150. In another alternative, the central portion 24 itself may comprise the fastening mechanism.

With reference to FIGS. 5A-5F, shown are diagrams illustrating perspective views of steps in an embodiment of a method of using a pouring device 100 for pouring material 195 from a container 150.

With reference to FIGS. 1A-6, embodiments are directed to a pouring device 100 for pouring material 195 from a container 150, the pouring device 100 being movable between a closed configuration and an open configuration different from the closed configuration. The pouring device 100 comprises: a main body 10 comprising a main body portion 12, an attachment portion 30, and at least two hinges 14, 16 which connect to at least two walls 20, 22 extending angularly (e.g., in a rotatable manner) from the main body portion 12 to form a conduit 26 (see, for example, FIGS. 1D and 2B) when the pouring device 100 is in the open configuration. The attachment portion 30 is placed within the container 150 below an upper plane of a rim 170 (see, for example, FIG. 3A) of the container 150 when the pouring device 100 is in the open and closed configurations. At least a portion of the at least two walls 20, 22 extends exteriorly from the container 150 above the upper plane of the rim 170 of the container 150 such that the material 195 from the container 150 is allowed to flow through the conduit 26, when the pouring device 100 is in the open configuration. The at least two walls 20, 22 retract to within the container 150 below the upper plane of the rim 170 of the container 150, when the pouring device 100 is in the closed configuration, thereby allowing the container 150 to be closed (e.g., sealed) by a closure mechanism with the pouring device 100 within the container 150. The attachment portion 30 may be configured to be attached to an interior portion of the container 150.

The angle that the at least two walls 20, 22 (and/or central portion 24, when included in an embodiment) extend from the main body portion 12 to form the conduit 26 may be within the range of, for example, approximately 40 to 179 degrees. However, the angle/extent that the walls 20, 22 (and central portion 24, when included in an embodiment) extend from the main body portion 12 in order to form the conduit 26 may vary as desired as long as at least a portion of the walls 20, 22 extend above the plane of the rim 170 of the container 150 when the pouring device 100 is in the open configuration.

The closure mechanism may comprise a lid, screw cap, end cap, snap cap, etc. for effecting closure of the container 150. The closure mechanism may be removably attached to the container 150 via a closure system such as screw threads or press-fit (which is commonly used for paint buckets). The rim 170 of the container 150 may comprise the closure system. The closure system may alternatively be employed within or on an inner sidewall 180 or outer sidewall of the container 150.

Figure 6:
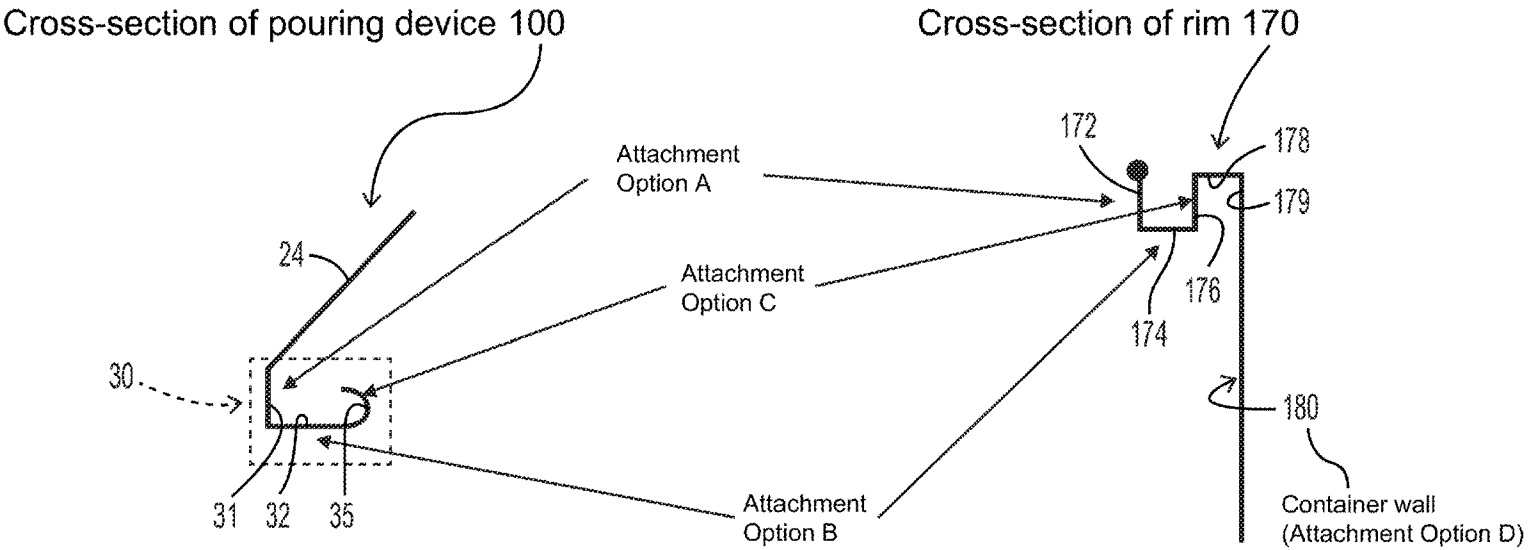
FIG. 6 is a diagram illustrating a cross-sectional side view of an embodiment of a pouring device, and a container rim and (possibly partial) inner sidewall, and multiple attachment options and attachment locations for attaching the pouring device to the rim and/or inner sidewall of the container, via the attachment portion of the pouring device.

With reference to FIG. 6, shown is a diagram illustrating a cross-sectional side view of an embodiment of a pouring device 100, and a container rim 170 and (possibly partial) inner sidewall 180, and multiple attachment options and attachment locations for attaching the pouring device 100 to the rim 170 and/or inner sidewall 180 of the container 150, via the attachment portion 30 of the pouring device 100. In an embodiment, the interior portion of the container 150 comprises a surface of the rim 170 below the upper plane. The interior portion of the container 150 may comprise a bottom surface 174 of the rim 170, an anterior portion 172 of the rim 170 facing a central space within the container 150, and/or a posterior portion 176 of the rim 170 facing an (upper part 179 of the) inner sidewall 180 of the container 150. As shown in FIG. 6, the attachment portion 30 may comprise a vertical/side portion 31, a horizontal/bottom portion 32, and a curled portion 35. The curled portion 35 may alternatively be replaced with ribbed portion 34 (see FIG. 1). Vertical/side portion 31 is designed to connect or make contact with anterior portion 172 (via FIG. 6's Attachment Option A). Horizontal/bottom portion 32 is designed to connect or make contact with bottom surface 174 (via FIG. 6's Attachment Option B). Curled portion 35 (or alternatively ribbed portion 34) is designed to connect or make contact with either or both of the posterior portion 176 or upper part 179 of the inner sidewall 180 (via FIG. 6's Attachment Option C). Vertical/side portion 31 and curled portion 35 may optionally "pinch" the rim 170 between the anterior portion 172 and the posterior portion 176. In another embodiment, curled portion 35 may be modified to provide a vertical portion (via FIG. 6's Attachment Option D) designed to be attached to any location on the inner sidewall 180. Of course, the dimensions, size, composition, and shape of any portions or surfaces of the attachment portion 30 may be modified or designed depending on the dimensions, size, composition, and shape of the intended location of attachment for a particular container.

In an embodiment, the interior portion of the container 150 comprises an inner sidewall 180 of the container 150.

In an embodiment, the attachment portion is configured to not be attached to a lid of the container 150, but rather is attached to an interior portion of the container.

Figure 5A:
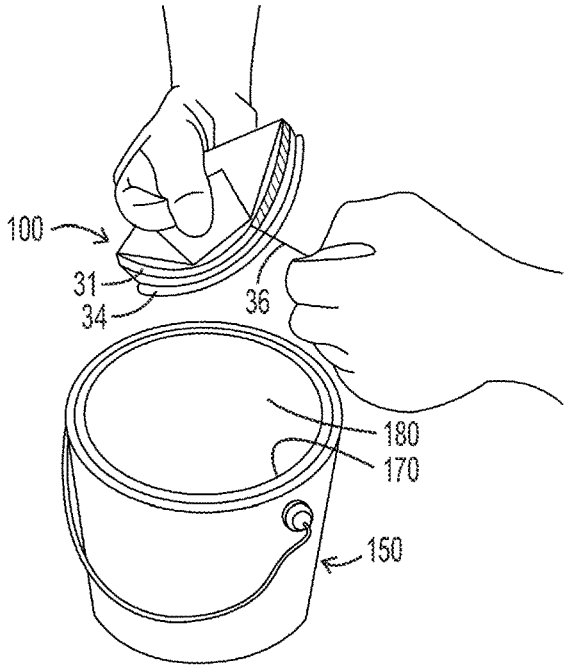
FIGS. 5A-5F are diagrams illustrating perspective views of steps in an embodiment of a method of using a pouring device for pouring material from a container.
Figure 5B:
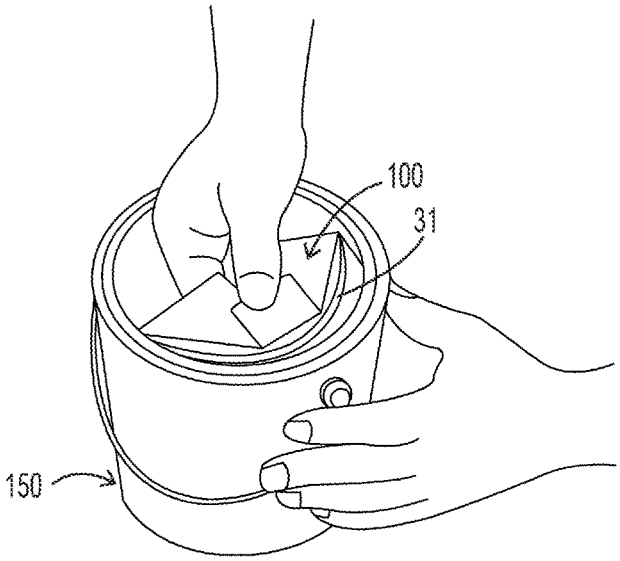
Figure 5C:
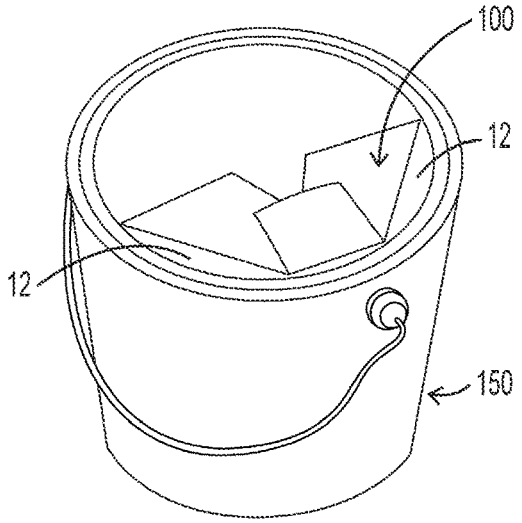
Figure 5D:
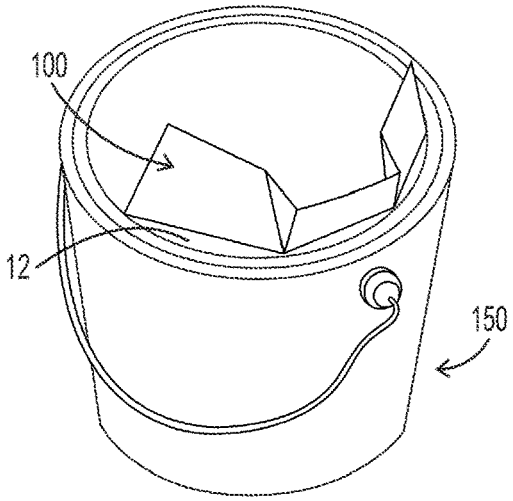
Figure 5E:
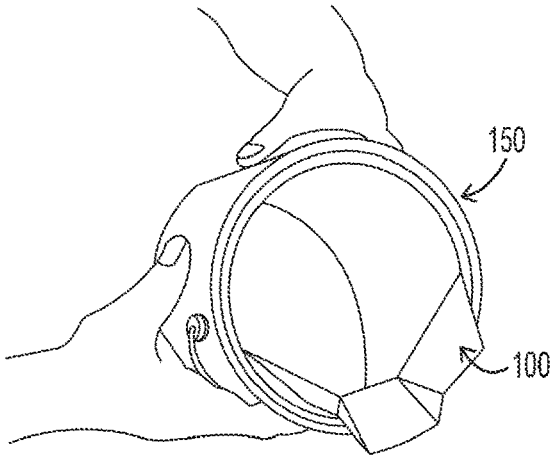
Figure 5F:
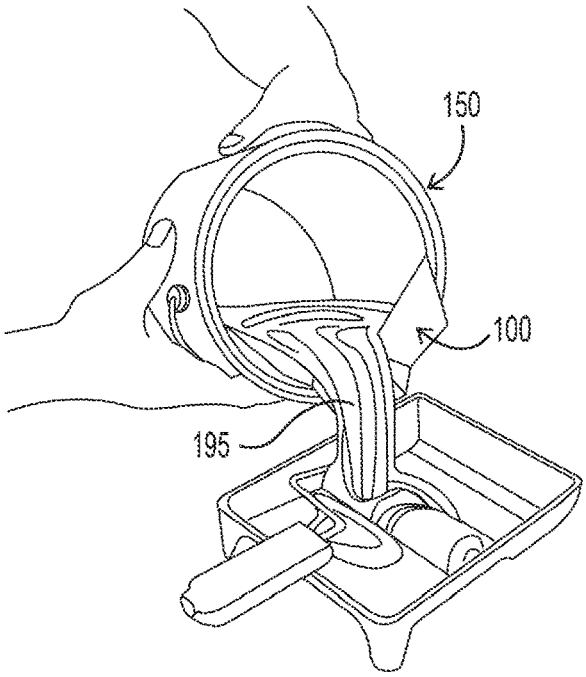

In an embodiment, the attachment portion 30 comprises an attachment mechanism, wherein the attachment portion 30 is configured to be attached to the interior portion of the container 150 via the attachment mechanism. The attachment portion 30 may comprise a vertical/side portion 31, a horizontal/bottom portion 32, and a ribbed portion 34 (or, alternatively, curled portion 35—see FIG. 6, or a vertical portion (not shown)). The attachment mechanism may be permanent or releasable, and may comprise any mechanism for attachment such as a chemical adhesive, magnetic mechanism (e.g., magnetic tape), mechanical interlock, thermal bonding, hook and loop fastener, adhesive tape, glue, epoxy, screw threads, friction-fit, polymer, press-fit, etc. The attachment mechanism may be added to the attachment portion 30 and/or the interior portion of the container 150 (e.g., at the rim 170 and/or inner sidewall 180 (including or excluding upper part 179 of the inner sidewall 180)) of the container 150 at the time of or before attaching the pouring device 100 to the container 150. In another alternative, the attachment portion 30 itself may be the attachment mechanism (i.e., no separate attachment mechanism would be used). FIG. 5A illustrates adhesive tape with covering 36 provided on vertical/side portion 31 and the covering 36 being pulled by a user in order to expose the adhesive under the covering 36.

In an embodiment, the combination of the main body portion 12 and the at least two walls 20, 22 (and central portion 24, when included in this embodiment) are substantially planar, when the pouring device 100 is in the closed configuration, and the combination of the main body portion 12 and the at least two walls 20, 22 (and central portion 24, when included in this embodiment) are not substantially planar, when the pouring device 100 is in the open configuration.

The combination of the at least two walls 20, 22 and the conduit 26 (and optionally a central portion 24 described below) may be considered as part of or the entirety of a "spout" when the pouring device 100 is in an open configuration.

In an embodiment, the pouring device 100 is biased toward only the closed configuration, only the open configuration, or both the closed and open configurations. To effect the biasing, the pouring device may, for example, be formed with an amount of pre-stress during the manufacturing of the pouring device. Such manufacturing methods capable of providing the pre-stressing or biasing may comprise, for example, thermo-forming, molding, vacuum forming, pressing, creasing, etc. When biasing is provided towards the closed configuration, the spout snaps or pops down toward a closed position when pulled or pushed into the closed configuration (i.e., such that the walls are substantially flush with the remaining portions of the pouring device, thereby allowing the lid to close with the pouring device still attached within the container). Similarly, when biasing is provided toward an open configuration, the spout snaps or pops up toward the open (i.e., pouring) position when pulled or pushed into the open configuration.

In an embodiment, each of the hinges 14, 16, 18 comprises an item selected from the group consisting of a perforation, crease, score, a section with less thickness than surrounding material, a section with less density than surrounding material, and a combination thereof.

In an embodiment, the conduit 26 is closed preventing the material 195 from the container 150 from flowing through the conduit 26, when the pouring device 100 is in the closed configuration.

In an embodiment, the pouring device 100 further comprises a central portion 24 positioned between the at least two hinges 18. The central portion 24 may extend angularly from the main body portion 12, when the pouring device 100 is in the open configuration.

In an embodiment, the central portion 24 comprises a fastening mechanism 160 which allows for maintaining closure of the conduit 26 when the pouring device 100 is in the closed configuration. The fastening mechanism 160 may releasably fasten the central portion 24 to at least one of the at least two walls 20, 22 when the pouring device 100 is in the closed configuration.

In an embodiment, the central portion 24 comprises a fastening mechanism 160 which allows for maintaining opening of the conduit 26 when the pouring device 100 is in the open configuration. The fastening mechanism 160 may releasably fasten the central portion 24 to an exterior portion of the container 150 when the pouring device 100 is in the open configuration.

Figure 8:
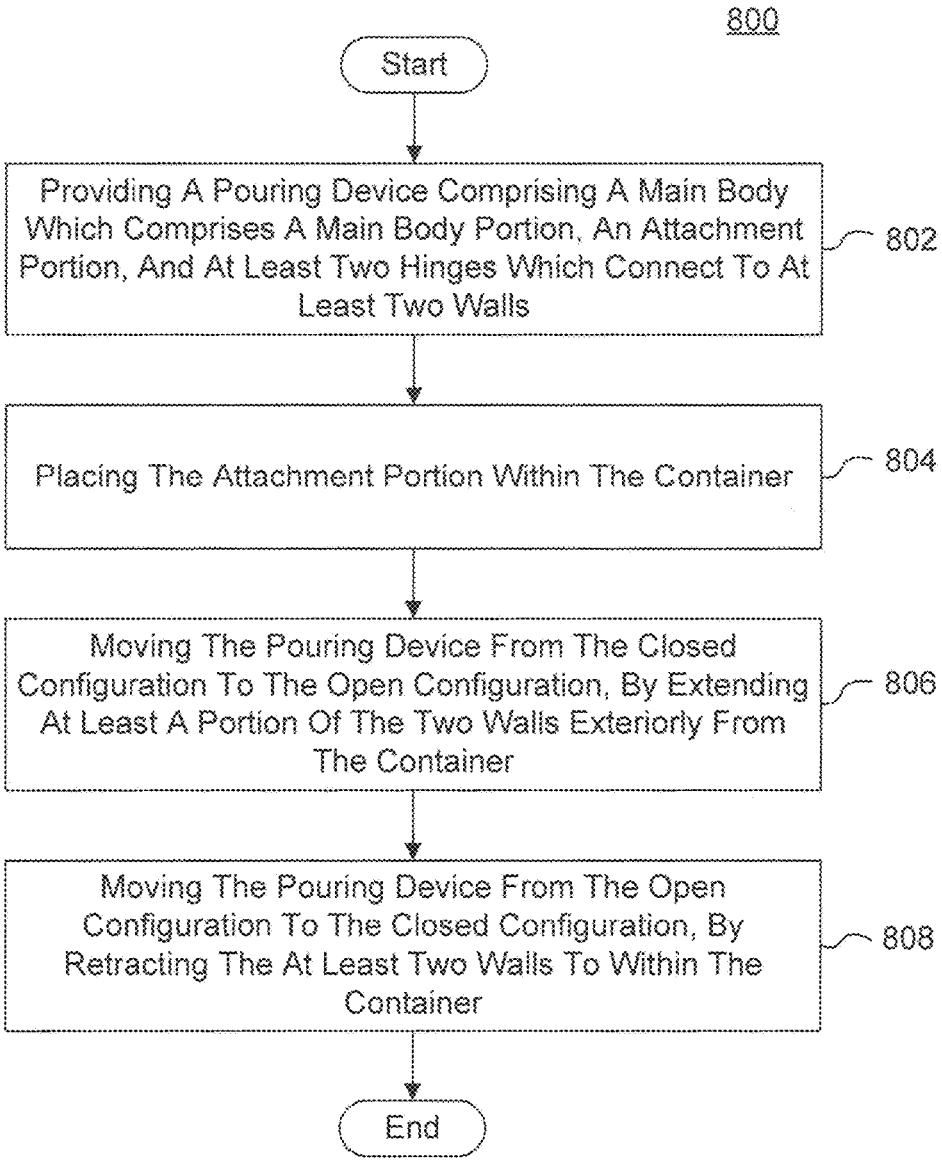
FIG. 8 is a flowchart illustrating an embodiment of a method of using a pouring device for pouring material from a container.

With reference to FIG. 8, shown is a flowchart illustrating an embodiment of a method 800 of using a pouring device for pouring material from a container. The pouring device is movable between a closed configuration and an open configuration different from the closed configuration. The method 800 includes: providing a pouring device comprising a main body which comprises a main body portion, an attachment portion, and at least two hinges which connect to at least two walls (block 802) extending angularly from the main body portion to form a conduit when the pouring device is in the open configuration; placing the attachment portion within the container (block 804) below an upper plane of a rim of the container; moving the pouring device from the closed configuration to the open configuration, while the attachment portion is positioned within the container below the upper plane of the rim of the container, by extending at least a portion of the two walls exteriorly from the container (block 806) above the upper plane of the rim of the container such that the material from the container is allowed to flow through the conduit, when the pouring device is in the open configuration; and moving the pouring device from the open configuration to the closed configuration, while the attachment portion is positioned within the container below the upper plane of the rim of the container, by retracting the at least two walls to within the container (block 808) below the upper plane of the rim of the container, when the pouring device is in the closed configuration, thereby allowing the container to be closed by a closure mechanism with the pouring device within the container. The step of placing may comprise attaching the attachment portion to an interior portion of the container.

In an embodiment, the interior portion of the container comprises a surface of the rim below the upper plane. The interior portion of the container may comprise a bottom surface of the rim, an anterior portion of the rim facing a central space within the container, and/or a posterior portion of the rim facing an inner sidewall of the container.

In an embodiment, the interior portion of the container comprises an inner sidewall of the container.

In an embodiment, the step of placing does not comprise attaching the attachment portion to a lid of the container, but rather may comprise attaching the attachment portion to an interior portion of the container.

In an embodiment, the attachment portion comprises an attachment mechanism, wherein the step of placing comprises attaching the attachment portion to the interior portion of the container via the attachment mechanism.

In an embodiment, the combination of the main body portion and the at least two walls are substantially planar, when the pouring device is in the closed configuration, and the combination of the main body portion and the at least two walls are not substantially planar, when the pouring device is in the open configuration.

In an embodiment, the pouring device is biased toward only the closed configuration, only the open configuration, or both the closed and open configurations.

In an embodiment, each of the hinges comprises an item selected from the group consisting of a perforation, crease, score, a section with less thickness than surrounding material, a section with less density than surrounding material, and a combination thereof.

In an embodiment, the conduit is closed preventing the material from the container from flowing through the conduit, when the pouring device is in the closed configuration.

In an embodiment, the method further comprises positioning a central portion between the at least two hinges. The central portion may extend angularly from the main body portion, when the pouring device is in the open configuration.

In an embodiment, the central portion comprises a fastening mechanism, wherein the method further comprises maintaining closure of the conduit via the fastening mechanism when the pouring device is in the closed configuration. The method may yet further comprise releasably fastening the central portion to at least one of the at least two walls via the fastening mechanism when the pouring device is in the closed configuration.

In an embodiment, the central portion comprises a fastening mechanism, wherein the method further comprises maintaining opening of the conduit via the fastening mechanism when the pouring device is in the open configuration. The method may yet further comprise releasably fastening the central portion to an exterior portion of the container via the fastening mechanism when the pouring device is in the open configuration.

Figure 7A:
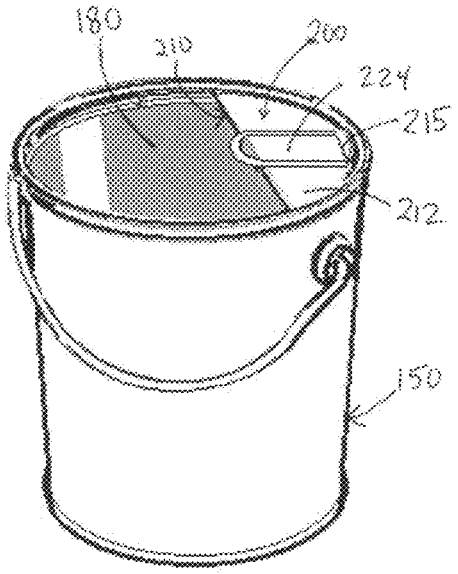
FIG. 7A is a diagram illustrating a perspective view of another embodiment of a pouring device with non-foldable walls for pouring material from a container, wherein the pouring device is in a closed configuration.
Figure 7B:
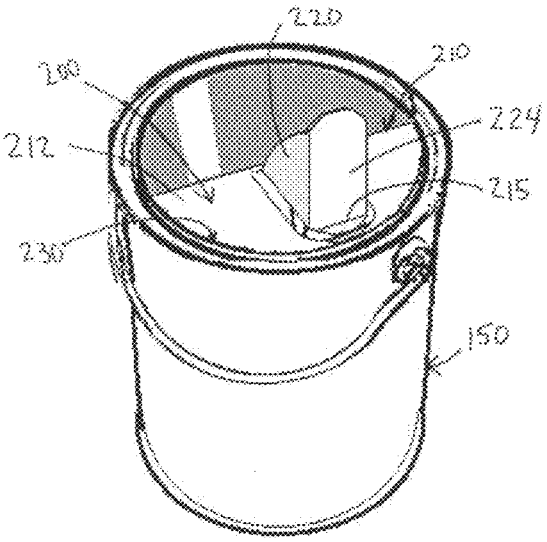
FIG. 7B is a diagram illustrating another perspective view of the pouring device shown in FIG. 7A, wherein the pouring device is in an open configuration.
Figure 7C:
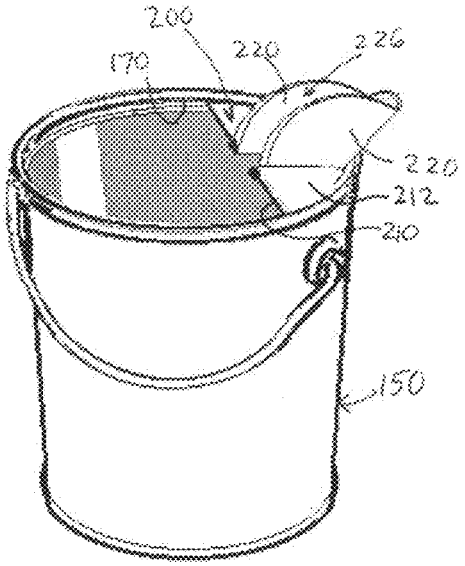
FIG. 7C is a diagram illustrating another perspective view of the pouring device shown in FIG. 7A, wherein the pouring device is in an open configuration. A conduit of the pouring device shown
Figure 7D:
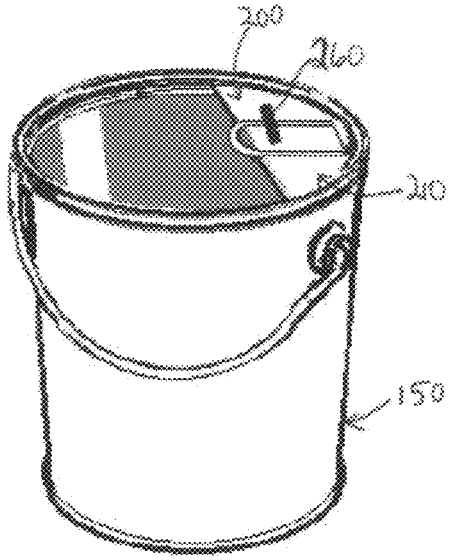
FIG. 7D is a diagram illustrating the container and attached pouring device shown in FIG. 7A, including a fastening mechanism, when the pouring device is in a closed configuration.
Figure 7E:
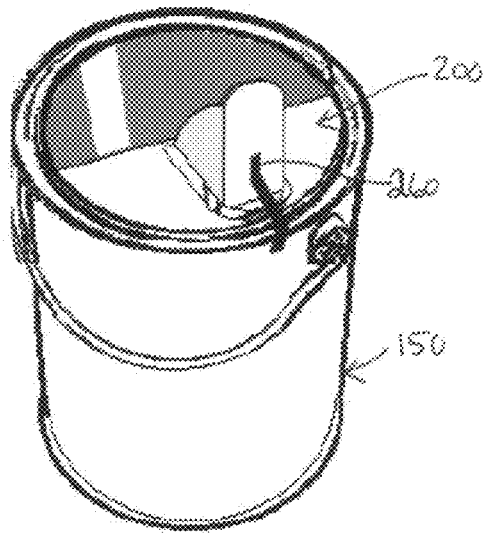
FIG. 7E is a diagram illustrating the container and attached pouring device shown in FIG. 7B, including a fastening mechanism, when the pouring device is in an open configuration.

With reference to FIG. 7A, shown is a diagram illustrating a perspective view of another embodiment of a pouring device 200 with non-foldable walls 220 for pouring material 195 from a container 150, wherein the pouring device 200 is in a closed configuration. FIG. 7B is a diagram illustrating another perspective view of the pouring device 200 shown in FIG. 7A, wherein the pouring device 200 is in an open configuration. FIG. 7C is a diagram illustrating another perspective view of the pouring device 200 shown in FIG. 7A, wherein the pouring device 200 is in an open configuration. A conduit 226 of the pouring device 200 shown in FIG. 7C is provided at an angle greater than that of a conduit 226 of the pouring device 200 shown in FIG. 7B. FIG. 7D is a diagram illustrating the container 150 and attached pouring device 200 shown in FIG. 7A, including a fastening mechanism 260, when the pouring device is in a closed configuration. FIG. 7E is a diagram illustrating the container 150 and attached pouring device 200 shown in FIG. 7B, including a fastening mechanism 260, when the pouring device 200 is in an open configuration.

With reference to FIGS. 7A-7E, embodiments are directed to a pouring device 200 for pouring material from a container 150, the pouring device 200 being movable between a closed configuration and an open configuration different from the closed configuration. The pouring device 200 comprises: a main body 210 comprising a main body portion 212, an attachment portion 230, and at least one hinge 215 which connects to a central portion 224 rigidly connecting two non-foldable walls 220 when the pouring device 200 is in the open and closed configurations. The central portion 224 and two walls 220 extend angularly from the main body portion 212 to form a conduit 226 when the pouring device 200 is in the open configuration. The attachment portion 230 is placed within the container 150 below an upper plane of a rim 170 of the container 150 when the pouring device 200 is in the open and closed configurations. At least a portion of the at least two walls 220 extends exteriorly from the container 150 above the upper plane of the rim 170 of the container 150 such that the material 195 from the container 150 is allowed to flow through the conduit 226, when the pouring device is in the open configuration. The at least two walls 220 retract to within the container 150 below the upper plane of the rim 170 of the container 150, when the pouring device 200 is in the closed configuration, thereby allowing the container 150 to be closed by a closure mechanism (e.g., lid) with the pouring device 200 within the container 150. The attachment portion 230 may be configured to be attached to an interior portion of the container 150.

In an embodiment, the interior portion of the container 150 comprises a surface of the rim 170 below the upper plane. The interior portion of the container 150 may comprise a bottom surface 174 of the rim 170, an anterior portion 172 of the rim 170 facing a central space within the container 150, and/or a posterior portion 176 of the rim 170 facing an (upper part 179 of the) inner sidewall 180 of the container 150.

In an embodiment, the interior portion of the container 150 comprises an inner sidewall 180 of the container 150.

In an embodiment, the attachment portion 230 comprises an attachment mechanism, wherein the attachment portion 230 is configured to be attached to the interior portion of the container 150 via the attachment mechanism.

The attachment portion 230 (and/or portion(s) thereof) may be identical or similar to the attachment portion 30 mentioned in any embodiment described above.

In an embodiment, the conduit 226 is closed preventing the material 195 from the container 150 from flowing through the conduit 226, when the pouring device 200 is in the closed configuration. In the closed configuration and with reference to FIG. 7A, the rigid, non-foldable walls 220 protrude through an opening in the main body portion 212, and extend towards the bottom of the container 150 (i.e., below the main body portion 212), while the top surface of central portion 224 optionally becomes substantially flush with the top surface of main body portion 212.

In an embodiment, the central portion 224 comprises a fastening mechanism 260 which allows for maintaining closure of the conduit 226 when the pouring device 200 is in the closed configuration. The fastening mechanism 260 may releasably fasten the central portion 224 to the main body portion 212 when the pouring device 200 is in the closed configuration.

In an embodiment, the central portion 224 comprises a fastening mechanism 260 which allows for maintaining opening of the conduit 226 when the pouring device 200 is in the open configuration. The fastening mechanism 260 may releasably fasten the central portion 224 to an exterior portion of the container 150 when the pouring device 200 is in the open configuration. The fastening mechanism 260 in FIG. 7D and the fastening mechanism 260 in FIG. 7E may be the same fastening mechanism, or different fastening mechanisms from each other. The fastening mechanism 260 may be identical or similar to the fastening mechanism 160 mentioned in any embodiment described above.

Although embodiments are described above with reference to a pouring device for removable mounting within a container, the pouring device described in any of the above embodiments may alternatively be made integral with or formed as a permanent part of a container as mentioned above. Such alternatives are considered to be within the spirit and scope of the present invention, and may therefore utilize the advantages of the configurations and embodiments described above.

In addition, although embodiments are described above with reference to a pouring device for mounting within a paint bucket/can, the pouring device described in any of the above embodiments may alternatively be employed in any container of any type that contains a pourable material as described above. Such alternatives are considered to be within the spirit and scope of the present invention, and may therefore utilize the advantages of the configurations and embodiments described above.

Further, although embodiments are described above with reference to a pouring device with a single-walled central portion, the central portion described in any of the above embodiments may alternatively comprise multiple walls that are either rigidly connected (e.g., in a non-planar manner) to each other or connected to each other via hinges. Such alternatives are considered to be within the spirit and scope of the present invention, and may therefore utilize the advantages of the configurations and embodiments described above.

Yet further, although embodiments are described above with reference to a pouring device having planar walls and a planar central portion, the walls and/or central portion described in any of the above embodiments may alternatively be non-planar and may comprise, for example, one or more curved (or other shape) walls, surfaces, or portions (e.g., natural curved shapes, bending shapes under stress, surfaces rigidly connected, surfaces connected by hinges, facets, or combinations thereof). Such alternatives are considered to be within the spirit and scope of the present invention, and may therefore utilize the advantages of the configurations and embodiments described above.

Yet further, although embodiments are described above with reference to a symmetrical pouring device (divided, for example, by a longitudinal central axis of the conduit 26), the pouring device described in any of the above embodiments may alternatively be made non-symmetrical with respect to the longitudinal central axis, e.g., with more foldable walls on one side of the longitudinal central axis versus on the other side of the longitudinal central axis. Such alternatives are considered to be within the spirit and scope of the present invention, and may therefore utilize the advantages of the configurations and embodiments described above.

The method steps in any of the embodiments described herein are not restricted to being performed in any particular order. Also, structures mentioned in any of the method embodiments may utilize structures mentioned in any of the device embodiments. Such structures may be described in detail with respect to the device embodiments only but are applicable to any of the method embodiments.

Features in any of the embodiments described in this disclosure may be employed in combination with features in other embodiments described herein, such combinations are considered to be within the spirit and scope of the present invention.

The contemplated modifications and variations specifically mentioned in this disclosure are considered to be within the spirit and scope of the present invention.

More generally, even though the present disclosure and exemplary embodiments are described above with reference to the examples according to the accompanying drawings, it is to be understood that they are not restricted thereto. Rather, it is apparent to those skilled in the art that the disclosed embodiments can be modified in many ways without departing from the scope of the disclosure herein. Moreover, the terms and descriptions used herein are set forth by way of illustration only and are not meant as limitations. Those skilled in the art will recognize that many variations are possible within the spirit and scope of the disclosure as defined in the following claims, and their equivalents, in which all terms are to be understood in their broadest possible sense unless otherwise indicated.

The invention claimed is:

1. A pouring device for pouring material from a container, the pouring device being movable between a closed configuration and an open configuration different from the closed configuration, the pouring device comprising:

a main body comprising a main body portion, an attachment portion, and at least two hinges which connect to at least two walls extending angularly from the main body portion to form a conduit when the pouring device is in the open configuration, wherein the attachment portion is placed within the container below an upper plane of a rim of the container when the pouring device is in the open and closed configurations, wherein at least a portion of the at least two walls extends exteriorly from the container above the upper plane of the rim of the container such that the material from the container is allowed to flow through the conduit, when the pouring device is in the open configuration, and wherein the at least two walls retract when the pouring device is in the closed configuration;

wherein a combination of the main body portion and the at least two walls are substantially planar, when the pouring device is in the closed configuration, and wherein the combination of the main body portion and the at least two walls are not substantially planar, when the pouring device is in the open configuration.

2. The pouring device of claim 1, wherein the attachment portion is configured to be attached to an interior portion of the container.

3. The pouring device of claim 2, wherein the interior portion of the container comprises a surface of the rim below the upper plane.

4. The pouring device of claim 3, wherein the interior portion of the container comprises a bottom surface of the rim.

5. The pouring device of claim 3, wherein the interior portion of the container comprises an anterior portion of the rim facing a central space within the container.

6. The pouring device of claim 3, wherein the interior portion of the container comprises a posterior portion of the rim facing an inner sidewall of the container.

7. The pouring device of claim 2, wherein the interior portion of the container comprises an inner sidewall of the container.

8. The pouring device of claim 2, wherein the attachment portion comprises an attachment mechanism, wherein the attachment portion is configured to be attached to the interior portion of the container via the attachment mechanism.

9. The pouring device of claim 1, wherein the attachment portion is configured to not be attached to a lid of the container.

10. The pouring device of claim 1, wherein the pouring device is biased toward only the closed configuration, only the open configuration, or both the closed and open configurations.

11. The pouring device of claim 1, wherein each of the hinges comprises an item selected from the group consisting of a perforation, crease, score, a section with less thickness than surrounding material, a section with less density than surrounding material, and a combination thereof.

12. The pouring device of claim 1, wherein the conduit is closed preventing the material from the container from flowing through the conduit, when the pouring device is in the closed configuration.

13. The pouring device of claim 1, further comprising a central portion positioned between the at least two hinges.

14. The pouring device of claim 13, wherein the central portion extends angularly from the main body portion, when the pouring device is in the open configuration.

15. The pouring device of claim 13, wherein the central portion comprises a fastening mechanism which allows for maintaining closure of the conduit when the pouring device is in the closed configuration.

16. The pouring device of claim 15, wherein the fastening mechanism releasably fastens the central portion to at least one of the at least two walls when the pouring device is in the closed configuration.

17. The pouring device of claim 13, wherein the central portion comprises a fastening mechanism which allows for maintaining opening of the conduit when the pouring device is in the open configuration.

18. The pouring device of claim 17, wherein the fastening mechanism releasably fastens the central portion to an exterior portion of the container when the pouring device is in the open configuration.

19. The pouring device of claim 1, wherein the at least two walls retract to within the container below the upper plane of the rim of the container, when the pouring device is in the closed configuration, thereby allowing the container to be closed by a closure mechanism with the pouring device within the container.

20. The pouring device of claim 1, wherein the at least two walls are configured to be positioned below a closure mechanism of the container when the pouring device is in the closed configuration.

21. A method of using a pouring device for pouring material from a container, the pouring device being movable between a closed configuration and an open configuration different from the closed configuration, the method comprising:

providing a pouring device comprising a main body which comprises a main body portion, an attachment portion, and at least two hinges which connect to at least two walls extending angularly from the main body portion to form a conduit when the pouring device is in the open configuration;

placing the attachment portion within the container below an upper plane of a rim of the container; and moving the pouring device from the closed configuration to the open configuration, while the attachment portion is positioned within the container below the upper plane of the rim of the container, by extending at least a portion of the at least two walls exteriorly from the container above the upper plane of the rim of the container such that the material from the container is allowed to flow through the conduit, when the pouring device is in the open configuration;

wherein a combination of the main body portion and the at least two walls are substantially planar, when the pouring device is in the closed configuration, and wherein the combination of the main body portion and the at least two walls are not substantially planar, when the pouring device is in the open configuration.

22. The method of claim 21, wherein the step of placing comprises attaching the attachment portion to an interior portion of the container.

23. The method of claim 22, wherein the interior portion of the container comprises a surface of the rim below the upper plane.

24. The method of claim 23, wherein the interior portion of the container comprises a bottom surface of the rim.

25. The method of claim 23, wherein the interior portion of the container comprises an anterior portion of the rim facing a central space within the container.

26. The method of claim 23, wherein the interior portion of the container comprises a posterior portion of the rim facing an inner sidewall of the container.

27. The method of claim 22, wherein the interior portion of the container comprises an inner sidewall of the container.

28. The method of claim 22, wherein the attachment portion comprises an attachment mechanism, wherein the step of placing comprises attaching the attachment portion to the interior portion of the container via the attachment mechanism.

29. The method of claim 21, wherein the step of placing does not comprise attaching the attachment portion to a lid of the container.

30. The method of claim 21, wherein the pouring device is biased toward only the closed configuration, only the open configuration, or both the closed and open configurations.

31. The method of claim 21, wherein each of the hinges comprises an item selected from the group consisting of a perforation, crease, score, a section with less thickness than surrounding material, a section with less density than surrounding material, and a combination thereof.

32. The method of claim 21, wherein the conduit is closed preventing the material from the container from flowing through the conduit, when the pouring device is in the closed configuration.

33. The method of claim 21, wherein the pouring device further comprises a central portion positioned between the at least two hinges.

34. The method of claim 33, wherein the central portion extends angularly from the main body portion, when the pouring device is in the open configuration.

35. The method of claim 33, wherein the central portion comprises a fastening mechanism, and wherein the method further comprises maintaining closure of the conduit via the fastening mechanism when the pouring device is in the closed configuration.

36. The method of claim 35, further comprising releasably fastening the central portion to at least one of the at least two walls via the fastening mechanism when the pouring device is in the closed configuration.

37. The method of claim 33, wherein the central portion comprises a fastening mechanism, and wherein the method further comprises maintaining opening of the conduit via the fastening mechanism when the pouring device is in the open configuration.

38. The method of claim 37, further comprising releasably fastening the central portion to an exterior portion of the container via the fastening mechanism when the pouring device is in the open configuration.

39. The method of claim 21, further comprising moving the pouring device from the open configuration to the closed configuration, while the attachment portion is positioned within the container below the upper plane of the rim of the container, by retracting the at least two walls, when the pouring device is in the closed configuration.

40. The method of claim 39, wherein the retracting comprises retracting the at least two walls to within the container below the upper plane of the rim of the container, thereby allowing the container to be closed by a closure mechanism with the pouring device within the container.

41. The method of claim 21, wherein the at least two walls are configured to be positioned below a closure mechanism of the container when the pouring device is in the closed configuration.

42. A pouring device for pouring material from a container, the pouring device being movable between a closed configuration and an open configuration different from the closed configuration, the pouring device comprising:

a main body comprising a main body portion, an attachment portion, and at least two hinges which connect to at least two walls extending angularly from the main body portion to form a conduit when the pouring device is in the open configuration, wherein the attachment portion is placed within the container below an upper plane of a rim of the container when the pouring device is in the open and closed configurations, wherein at least a portion of the at least two walls extends exteriorly from the container above the upper plane of the rim of the container such that the material from the container is allowed to flow through the conduit, when the pouring device is in the open configuration, and wherein the at least two walls retract when the pouring device is in the closed configuration;

wherein the pouring device is biased toward only the closed configuration, only the open configuration, or both the closed and open configurations.

43. The pouring device of claim 42, wherein the attachment portion is configured to be attached to an interior portion of the container.

44. The pouring device of claim 42, wherein the attachment portion is configured to not be attached to a lid of the container.

45. The pouring device of claim 42, wherein each of the hinges comprises an item selected from the group consisting of a perforation, crease, score, a section with less thickness than surrounding material, a section with less density than surrounding material, and a combination thereof.

46. The pouring device of claim 42, further comprising a central portion positioned between the at least two hinges.

47. The pouring device of claim 46, wherein the central portion extends angularly from the main body portion, when the pouring device is in the open configuration.

48. A method of using a pouring device for pouring material from a container, the pouring device being movable between a closed configuration and an open configuration different from the closed configuration, the method comprising:

providing a pouring device comprising a main body which comprises a main body portion, an attachment portion, and at least two hinges which connect to at least two walls extending angularly from the main body portion to form a conduit when the pouring device is in the open configuration;

placing the attachment portion within the container below an upper plane of a rim of the container; and moving the pouring device from the closed configuration to the open configuration, while the attachment portion is positioned within the container below the upper plane of the rim of the container, by extending at least a portion of the at least two walls exteriorly from the container above the upper plane of the rim of the container such that the material from the container is allowed to flow through the conduit, when the pouring device is in the open configuration;

wherein the pouring device is biased toward only the closed configuration, only the open configuration, or both the closed and open configurations.

49. The method of claim 48, wherein the step of placing comprises attaching the attachment portion to an interior portion of the container.

50. The method of claim 48, wherein the step of placing does not comprise attaching the attachment portion to a lid of the container.

51. The method of claim 48, wherein each of the hinges comprises an item selected from the group consisting of a perforation, crease, score, a section with less thickness than surrounding material, a section with less density than surrounding material, and a combination thereof.

52. The method of claim 48, wherein the pouring device further comprises a central portion positioned between the at least two hinges.

53. The method of claim 52, wherein the central portion extends angularly from the main body portion, when the pouring device is in the open configuration.

* * * * *